US012349751B2

(12) United States Patent
Zhang

(10) Patent No.: US 12,349,751 B2
(45) Date of Patent: Jul. 8, 2025

(54) CONTROL STRUCTURE AND ORNAMENT

(71) Applicant: Yangzhou Haopu Toys and Gifts Co., Ltd., Yangzhou (CN)

(72) Inventor: Laifei Zhang, Yizheng (CN)

(73) Assignee: Yangzhou Haopu Toys and Gifts Co., Ltd., Yangzhou (CN)

( * ) Notice: Subject to any disclaimer, the term of this patent is extended or adjusted under 35 U.S.C. 154(b) by 0 days.

(21) Appl. No.: 18/762,442

(22) Filed: Jul. 2, 2024

(65) Prior Publication Data

US 2024/0349835 A1 Oct. 24, 2024

(51) Int. Cl.
*A42B 1/004* (2021.01)
*A42B 1/203* (2021.01)

(52) U.S. Cl.
CPC ..... *A42B 1/004* (2013.01); *A42B 1/203* (2013.01)

(58) Field of Classification Search
CPC ..... A42B 1/004; A42B 1/203
USPC ..... 446/183, 185, 198, 220–226
See application file for complete search history.

(56) References Cited

U.S. PATENT DOCUMENTS 4,057,928 A * 11/1977 Terzian ..... A63H 7/00 446/306
8,266,828 B2 * 9/2012 Strong ..... A63H 3/003 446/221
8,863,318 B2 * 10/2014 Strong ..... A42B 1/201 2/200.1
9,215,914 B2 * 12/2015 Strong ..... A45F 3/04
2013/0160188 A1 * 6/2013 Strong ..... A42B 1/004 2/209.13
2016/0069361 A1 * 3/2016 Strong ..... A63H 3/06 92/137

FOREIGN PATENT DOCUMENTS

CN 210382793 U 4/2020
CN 220458692 U 2/2024

* cited by examiner

*Primary Examiner* — Nini F Legesse

(57) ABSTRACT

The invention relates to a control structure and an ornament, the control structure comprises an air bag and an actuating portion which are communicated, the actuating portion comprises a fixed portion and a moving portion which are connected at an included angle, the fixed portion is close to the air bag relative to the moving portion, at least two moving portions are provided, a volume of the air bag is capable of being repeatedly increased and decreased, and when the volume of the air bag is decreased, air in the air bag is capable of entering the actuating portion, so that the moving portion is moved and the included angle between the fixed portion and the moving portion is increased, thus switching a folded state of the actuating portion to an unfolded state.

10 Claims, 7 Drawing Sheets

CONTROL STRUCTURE AND ORNAMENT

TECHNICAL FIELD

The present invention relates to the technical field of toys, and particularly to a control structure and an ornament.

BACKGROUND OF THE PRESENT INVENTION

In the prior art, a headgear imitating a shape of a rabbit comprises a control structure and a sleeve wrapped outside the control structure, the sleeve has a shape similar to a head of a rabbit, and ears on the headgear may be unfolded and folded by controlling the control structure.

However, in the prior art, it is necessary to exert a large acting force on the control structure, and then the ears on the ornament can be unfolded, leading to the difficult operation by users and poor experience.

SUMMARY OF THE PRESENT INVENTION

One object of the present invention is to provide a control structure, so as to solve at least one of the technical problems above.

In order to achieve the above object, in a first aspect, the present invention provides a control structure, which comprises an air bag and an actuating portion which are communicated, wherein the actuating portion comprises a fixed portion and a moving portion which are connected at an included angle, the fixed portion is close to the air bag relative to the moving portion, at least two moving portions are provided, a volume of the air bag is capable of being repeatedly increased and decreased, and when the volume of the air bag is decreased, air in the air bag is capable of entering the actuating portion, so that the moving portion is moved and the included angle between the fixed portion and the moving portion is increased, thus switching a folded state of the actuating portion to an unfolded state.

Optionally, the control structure further comprises a connecting pipe, and the air bag and the actuating portion are connected through the connecting pipe.

Optionally, the connecting pipe is detachably connected with the actuating portion.

Optionally, one end of one connecting pipe is connected with one or more actuating portions.

Optionally, the air bag and/or the actuating portion are made of blow-molded plastic or thermoplastic rubber.

Optionally, the volume of the air bag is greater than that of the actuating portion.

Optionally, the volume of the air bag is 4 to 30 times that of the actuating portion.

Optionally, the moving portion is in a hollow flat structure.

Optionally, the control structure further comprises a valve, the valve is connected to the connecting pipe, and the valve allows external air to enter the connecting pipe and restricts air in the connecting pipe from flowing out.

Optionally, the valve comprises a valve body and a valve sheet, a valve cavity is arranged in the valve body, the valve body is further provided with an air channel and an air inlet which are both communicated with the valve cavity, a first opening at a first end of the air channel is connected with the connecting pipe, a second end of the air channel is also provided with a second opening, wherein the first end is opposite to the second end, and the second opening is communicated with the valve cavity.

Another object of the present invention is to provide an ornament, so as to solve at least one of the technical problems above.

In order to achieve the object, in a second aspect, the present invention adopts the following technical solution.

An ornament comprises a fabric and the control structure above arranged in the fabric, wherein the fabric comprises a body and a moving structure connected to the body, and at least the moving portion is arranged in the moving structure.

Optionally, an opening is arranged between the moving structure and the body, and the actuating portion is capable of entering and withdrawing from the fabric through the opening; and/or, a limit channel is arranged in the fabric, the connecting pipe of the control structure extends along the limit channel, and the air bag and the actuating portion of the control structure are located outside the limit channel, and located at two ends of the limit channel.

Optionally, the fixed portion is located at a joint of the body and the moving structure, and/or, the moving portion is located in the moving structure.

It can be seen from the above that, in the technical solution provided by the present invention, when a user operates the control structure, the volume of the air bag can be reduced by squeezing the air bag, and in a process of squeezing the air bag, a pressure in the air bag is greater than that of the actuating portion, and air in the air bag enters the actuating portion and fills the actuating portion, so that the moving portion is moved and unfolded, thus making the actuating portion in the unfolded state. When the user releases the air bag, there is a negative pressure in the air bag relative to the actuating portion, so that air in the actuating portion enters the air bag again, and the volume of the air bag is increased to an original state, and meanwhile, air in the moving portion is decreased, and the air in the moving portion cannot support the moving portion and the fixed portion, so that the actuating portion is restored to the folded state.

Because there are at least two actuating portions, and a space between the two actuating portions does not need to be filled with air, compared with one actuating portion with the same volume, at least two actuating portions can reduce a volume of air required by the actuating portion, so as to realize an effect of small-scale squeezing on the air bag and an effect of large-scale movement of the moving portion, thus reducing a squeezing scale on the air bag and an acting force on the air bag by a user, facilitating the operation of the user, and improving the experience of the user. Meanwhile, compared with one actuating portion with the same volume, at least two actuating portions are more dispersed in the fabric, and when the actuating portion is switched from the folded state to the unfolded state, an acting force on the fabric is more uniform, and the fabric is easier to move.

The ornament comprises the fabric and the control structure above, the control structure is arranged in the fabric, the fabric comprises the body and the moving structure connected to the body, and at least the moving portion is arranged in the moving structure, so that the moving structure is moved along with the movement of the moving portion. Specifically, when the actuating portion is in the folded state, the moving structure is close to the body, and the moving structure is folded, and when the actuating portion is in the folded state due to the movement of the moving portion, a free end of the moving structure (one end not connected with the body) is moved away from the body, and the moving structure is unfolded.

Figure 1:
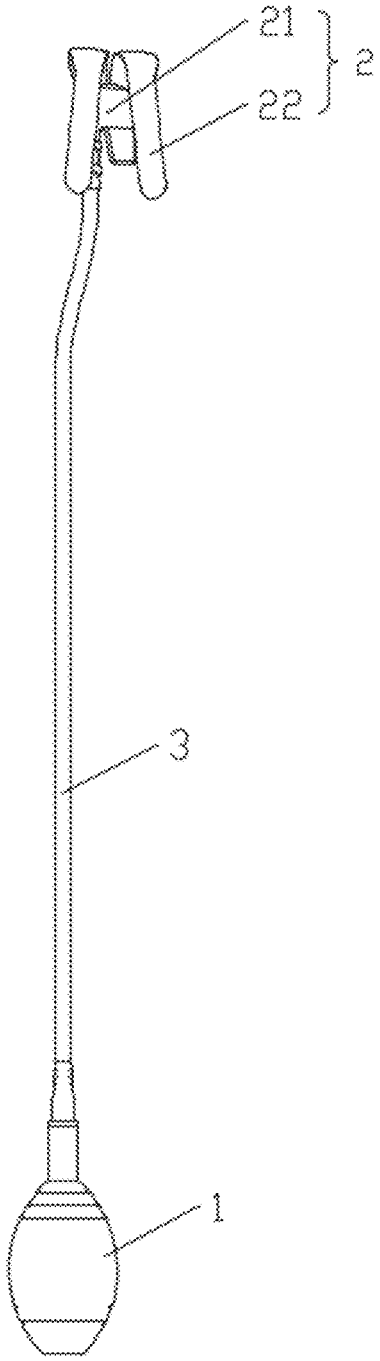
FIG. 1 is a schematic structural diagram of a control structure (with an actuating portion in a folded state) provided by an embodiment of the present invention.

1 refers to air bag;

2 refers to actuating portion; 21 refers to moving portion; 22 refers to fixed portion;

3 refers to connecting pipe;

4 refers to valve; 41 refers to valve body; 411 refers to valve cavity; 412 refers to air channel; 414 refers to air inlet; 43 refers to valve sheet; 4121 refers to first opening; 4122 refers to second opening;

101 refers to headgear body; 102 refers to extension sleeve; 103 refers to limit channel; and 200 refers to moving structure.

DETAILED DESCRIPTION OF PREFERRED EMBODIMENTS

Technical solutions of the present invention are further described hereinafter with reference to the drawings and specific embodiments. It can be understood that the specific embodiments described herein are only used for explaining the present invention and are not intended to limit the present invention. In addition, it should also be noted that, for convenience of description, only some parts but not all parts related to the present invention are shown in the drawings.

Some directional words are defined in the present invention, unless otherwise stated, the directional words used, such as "up", "down", "left", "right", "inside" and "outside" are used for the convenience of understanding, and do not limit the scope of protection of the present invention.

In the present invention, unless otherwise specified and limited, the first feature "on" or "under" the second feature may include direct contact between the first feature and the second feature, and may also include the contact between the first feature and the second feature through another feature therebetween instead of the direct contact. Furthermore, the first feature "on", "above" and "over" the second feature includes that the first feature is directly above and obliquely above the second feature, or only indicates that the first feature is higher than the second feature in a horizontal height. The first feature "under", "below" and "underneath" the second feature includes that the first feature is directly below and obliquely below the second feature, or only indicates that the first feature is lower than the second feature in a horizontal height.

In the description of the present invention, the terms "connected", "connection" and "fixation" should be understood in broad sense unless otherwise specified and defined. For example, they may be fixed connection, removable connection or integrated connection; may be mechanical connection or electrical connection; and may be direct connection, or indirect connection through an intermediate medium, and connection inside two elements, or interaction relation of two elements. The specific meanings of the above terms in the present invention can be understood in a specific case by those of ordinary skills in the art.

The embodiment provides a control structure, which is used in a toy, but is not limited to this, so that a certain part of the toy may be moved, and the control structure provided by the embodiment is convenient to operate, which can improve the experience of a user.

Figure 2:
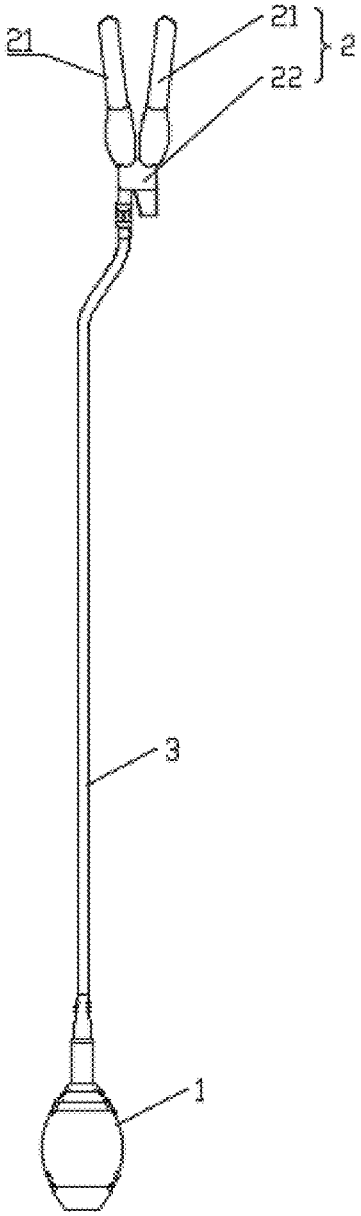
FIG. 2 is a schematic structural diagram of the control structure (with the actuating portion in an unfolded state) provided by the embodiment of the present invention.

As shown in FIG. 1 and FIG. 2, the control structure provided by the embodiment comprises an air bag 1 and an actuating portion 2 which are communicated, wherein the actuating portion 2 comprises a fixed portion 22 and a moving portion 21 which are connected at an included angle, and the fixed portion 22 is close to the air bag 1 relative to the moving portion 21, that is, the air bag 1, the fixed portion 22 and the moving portion 21 are arranged in sequence. At least two moving portion 21 are provided. Illustratively, in the embodiment, one actuating portion 2 is provided with two moving portions 21. A volume of the air bag 1 can be repeatedly increased and decreased. For example, the volume of the air bag 1 can be decreased by squeezing the air bag 1, and the volume of the air bag can be increased to an original state by releasing the air bag 1.

When the volume of the air bag 1 is decreased, air in the air bag 1 can enter the actuating portion 2, so that the moving portion 21 is moved and the included angle between the fixed portion 22 and the moving portion 21 is increased, thus switching a folded state of the actuating portion 2 to an unfolded state.

Figure 3:
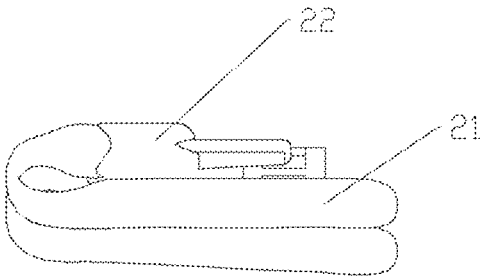
FIG. 3 is a schematic structural diagram of the actuating portion in the folded state provided by the embodiment of the present invention.
Figure 4A:
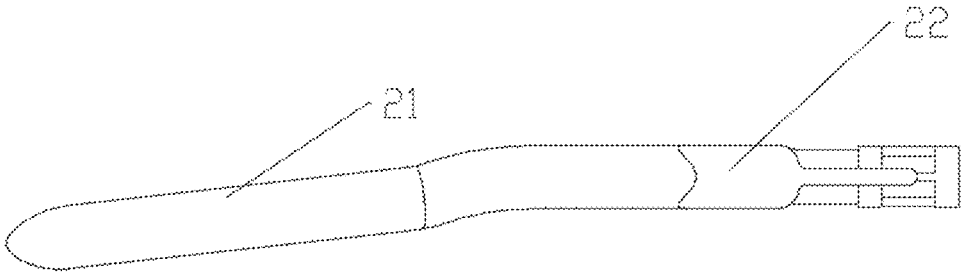
FIG. 4 is a schematic structural diagram of the actuating portion in the unfolded state provided by the embodiment of the present invention.
FIG. 4*b* is a schematic structural diagram of another control structure provided by the embodiment of the present invention.
FIG. 4*c* is a schematic structural diagram of an air inlet of a control valve in a blocked state provided by the embodiment of the present invention.
FIG. 4*d* is a schematic structural diagram of the air inlet of the control valve in an open state provided by the embodiment of the present invention.

As shown in FIG. 1 and FIG. 3, the actuating portion 2 is in the folded state, and at this time, the fixed portion 22 and the moving portion 21 are folded in half, that is, the fixed portion 22 and the moving portion 21 are approximately parallel, and the included angle between the fixed portion and the moving portion is approximately 0°. However, when the actuating portion 2 is in the folded state, the included angle between the fixed portion 22 and the moving portion 21 is not limited to this, and the included angle between the fixed portion and the moving portion may also be an acute angle. As shown in FIG. 2 and FIG. 4*a*, the actuating portion 2 is in the unfolded state, and at this time, the fixed portion 22 and the moving portion 21 are approximately spread out and located on the same plane, that is, the included angle between the fixed portion 22 and the moving portion 21 is approximately 180°. However, when the actuating portion 2 is in the unfolded state, the included angle between the fixed portion 22 and the moving portion 21 is not limited to this, and the included angle between the fixed portion and the moving portion may also be an obtuse angle.

When a user operates the control structure, the volume of the air bag 1 can be reduced by squeezing the air bag 1, and in a process of squeezing the air bag 1, a pressure in the air bag 1 is greater than that of the actuating portion 2, and air in the air bag 1 enters the actuating portion 2 and fills the actuating portion 2, so that the moving portion 21 is moved and unfolded, thus making the actuating portion 2 in the unfolded state. When the user releases the air bag 1, there is a negative pressure in the air bag 1 relative to the actuating portion 2, so that air in the actuating portion 2 enters the air bag 1 again, and the volume of the air bag 1 is increased to an original state, and meanwhile, air in the moving portion 21 is decreased, and the air in the moving portion 21 cannot support the moving portion 21 and the fixed portion 22, so that the actuating portion 2 is restored to the folded state.

Because there are at least two actuating portions 2, and a space between the two actuating portions 2 does not need to be filled with air, compared with one actuating portion with the same volume, at least two actuating portions 2 can reduce a volume of air required by the actuating portion 2, so as to realize an effect of small-scale squeezing on the air bag 1 and an effect of large-scale movement of the moving portion 21, thus reducing a squeezing scale on the air bag 1 and an acting force on the air bag 1 by a user, facilitating the operation of the user, and improving the experience of the user. Meanwhile, compared with one actuating portion 2 with the same volume, at least two actuating portions 2 are more dispersed in the fabric, and when the actuating portion 2 is switched from the folded state to the unfolded state, an acting force on the fabric is more uniform, and the fabric is easier to move.

As shown in FIG. 1 and FIG. 2, further, two adjacent moving portions 21 are arranged at an included angle, for example, a V-shape is formed between the two adjacent moving portions 21, so as to make an acting force on the fabric more uniform.

Optionally, the volume of the air bag 1 is much greater than that of the actuating portion 2, so that the volume of the air bag 1 changes slightly, and the actuating portion 2 may be filled with air and unfolded, thus further reducing a squeezing scale of the air bag 1, further facilitating the operation by the user and improving the experience of the user. Specifically, the volume of the air bag 1 is 4 to 30 times that of the actuating portion 2.

Optionally, as shown in FIG. 1 to FIG. 2, the moving portion 21 is in a hollow flat structure, so as to increase a contact area with the fabric, so that the fabric is unfolded more smoothly, and the imitation of ears of an animal such as a rabbit is more realistic.

As shown in FIG. 1 to FIG. 2, the control structure further comprises a connecting pipe 3, and the air bag 1 and the actuating portion 2 are connected through the connecting pipe 3. When the ornament is a headwear, the actuating portion 2 is located on the head of the user. If the actuating portion 2 is directly connected with the air bag 1, it is inconvenient for the user to squeeze the air bag 1. In the embodiment, the connecting pipe 3 is arranged, and when the control structure is used, the connecting pipe 3 extends in a vertical direction, an upper end of the connecting pipe 3 is connected with the actuating portion 2, and a lower end of the connecting pipe is connected with the air bag 1. At this time, the actuating portion 2 may be located on the head of the user, and the air bag 1 may be located on the waist of the user and other positions easily touched by the hands, thus facilitating the user to squeeze the air bag 1.

Optionally, the connecting pipe 3 is detachably connected with the actuating portion 2, so that when the connecting pipe 3 or the actuating portion 2 is damaged, only the damaged part needs to be replaced, which reduces a cost required for replacement by the user.

Optionally, the connecting pipe 3 and the actuating portion 2 are detachably connected through a hard inserting pipe, so that the connecting pipe 3 and the actuating portion 2 may be conveniently connected through the hard inserting pipe. Optionally, the hard inserting pipe may be in interference-fit with the connecting pipe 3 and the actuating portion 2 to realize sealed connection.

Illustratively, the connecting pipe 3 may also be detachably connected with the air bag 1, for example, the connecting pipe 3 and the air bag 1 may also be detachably connected through a hard inserting pipe, so that when one of the parts is damaged, only the damaged part needs to be replaced, which reduces a cost required for replacement by the user. Optionally, the hard inserting pipe may be in interference-fit with the connecting pipe 3 and the air bag 1 to realize sealed connection.

Optionally, the air bag 1 and/or the actuating portion 2 are made of blow-molded plastic or thermoplastic rubber. The blow-molded plastic and the thermoplastic rubber (TPR) are flexible enough to be repeatedly squeezed and restored. Polymers such as the blow-molded plastic and the thermoplastic rubber have good memory, so that the actuating portion 2 may always be restored to the folded state in a natural state, and the materials may be stretched and expanded, thus reducing the risk of damage to the control structure.

Illustratively, a cross-section of the air bag 1 is circular or elliptical, and a cross-sectional area of the air bag 1 is gradually increased from one end to the other end, and then gradually decreased, thus facilitating the user to hold the air bag 1.

Figure 6:
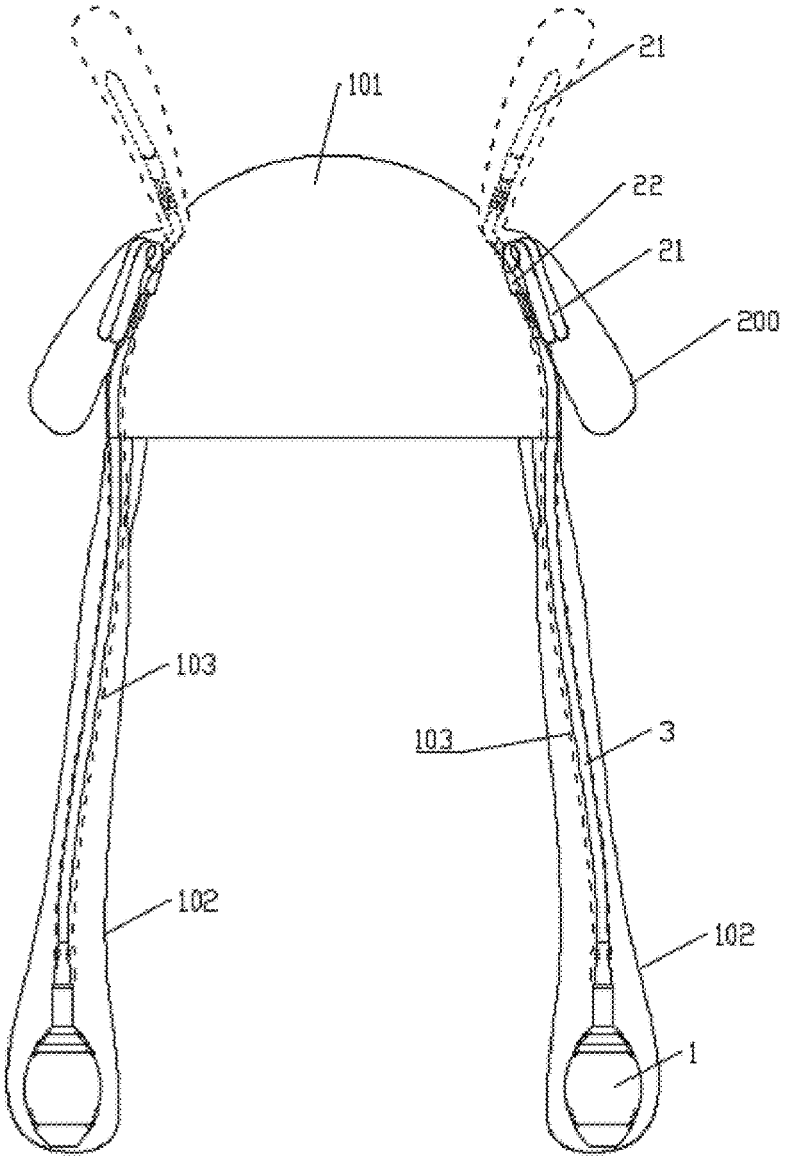
FIG. 6 is a perspective view of the ornament provided by the embodiment of the present invention.

Optionally, one end of one connecting pipe 3 is connected with one or more actuating portions 2. One actuating portion 2 may control a part of the ornament to be folded and unfolded. As shown in FIG. 1, FIG. 2 and FIG. 6, when one end of one connecting pipe 3 is connected with one actuating portion 2, multiple parts of the ornament need to be folded and unfolded, and multiple control structures may be placed in the ornament, which facilitates the user to control the multiple parts of the ornament to be folded and unfolded respectively, thus increasing the interest of the ornament. When one end of one connecting pipe 3 is connected with multiple actuating portions 2, the multiple actuating portions 2 may control the multiple parts of the ornament to be folded and unfolded at the same time, thus decreasing a number of control structures and reducing a cost of the ornament.

Figure 4B:
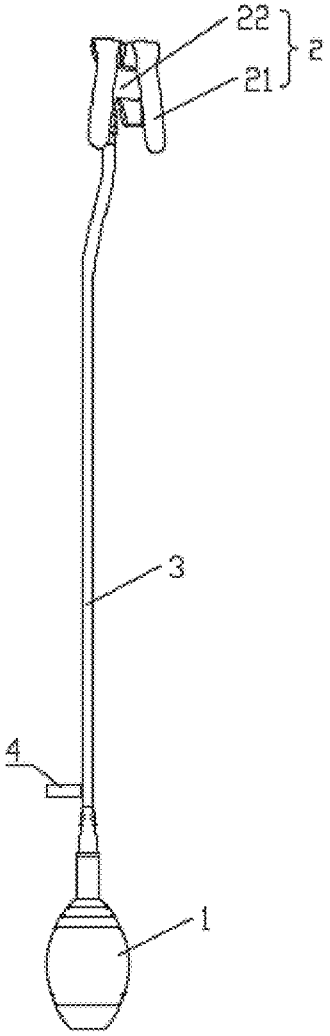
Figure 4C:
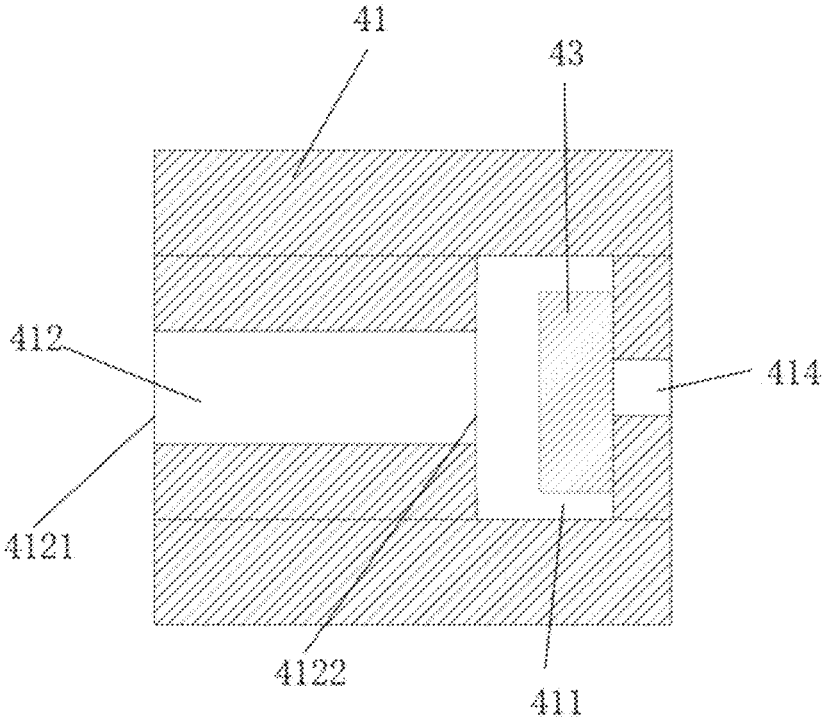
Figure 4D:
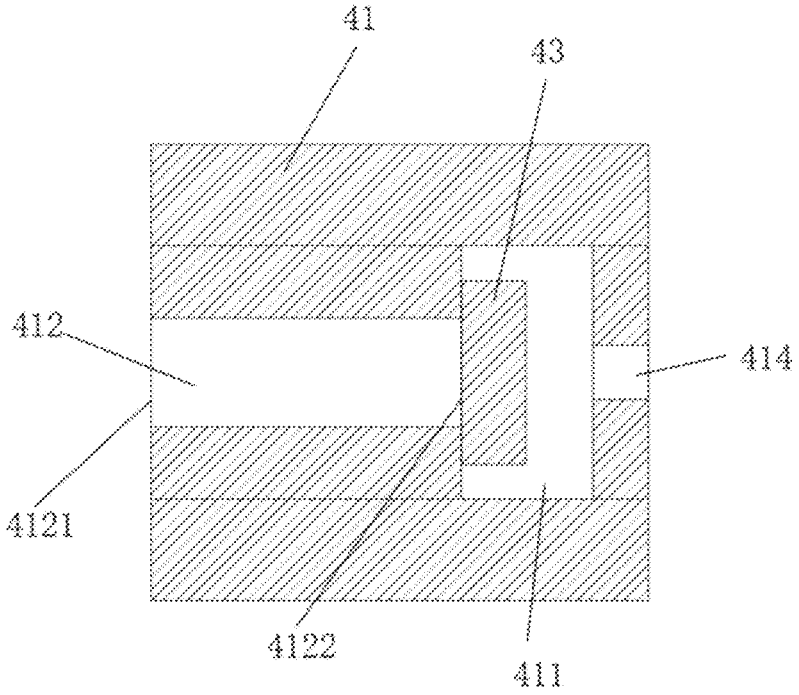

As shown in FIG. 4*b* to FIG. 4*d*, the control structure further comprises a valve 4, the valve 4 is connected to the connecting pipe 3, and the valve 4 allows external air to enter the connecting pipe 3 and restricts air in the connecting pipe 3 from flowing out. Specifically, when the air bag 1 is squeezed, the valve 4 may restrict the air in the connecting pipe 3 from flowing out, which allows all the air in the air bag 1 to enter the actuating portion 2, so that the moving portion 21 may be moved greatly when the air bag 1 is squeezed slightly. When the air bag 1 is released, the valve 4 allows the external air to enter the connecting pipe 3, so that the air bag 1 may be quickly restored to a shape before squeezing.

Optionally, the valve 4 is connected to one end of the connecting pipe 3 close to the air bag 1, so that air entering from the valve 4 may quickly enter the air bag 1.

As shown in FIG. 4*c* and FIG. 4*d*, the valve 4 may comprise a valve body 41 and a valve sheet 43, a valve cavity 411 is arranged in the valve body 41, the valve body 41 is further provided with an air channel 412 and an air inlet 414 which are both communicated with the valve cavity 411, a first opening 4121 at a first end of the air channel 412 is connected with the connecting pipe 3, a second end of the air channel 412 is also provided with a second opening 4122, wherein the first end is opposite to the second end, and the second opening 4122 is communicated with the valve cavity 411. Preferably, the second opening 4122 and the air inlet 414 are arranged at two opposite ends of the valve cavity 411, the second opening 4122 is close to the valve cavity 411, and the valve sheet 43 may move back and forth in the valve cavity 411 to block the air inlet 414 or open the air inlet 414.

As shown in FIG. 4*c*, when the air bag 1 is squeezed, the air in the air bag 1 enters the valve cavity 411 through the connecting pipe 3 and the air channel 412, and pushes the valve sheet 43 to move to a side on which the air inlet 414 is located until the valve sheet 43 blocks the air inlet 414, thus preventing the air in the air bag 1 from flowing out through the air inlet 414. As shown in FIG. 4*d*, when the air bag 1 is released, the valve sheet 43 is reset to block the second opening 4212 of the air channel 412, and during the resetting of the valve sheet 43, air passes through the air inlet 414, the valve cavity 411 and the air channel 412 in sequence to enter the connecting pipe 3 and the air bag 1, so that the air bag 1 is quickly restored and deformed.

Figure 5:
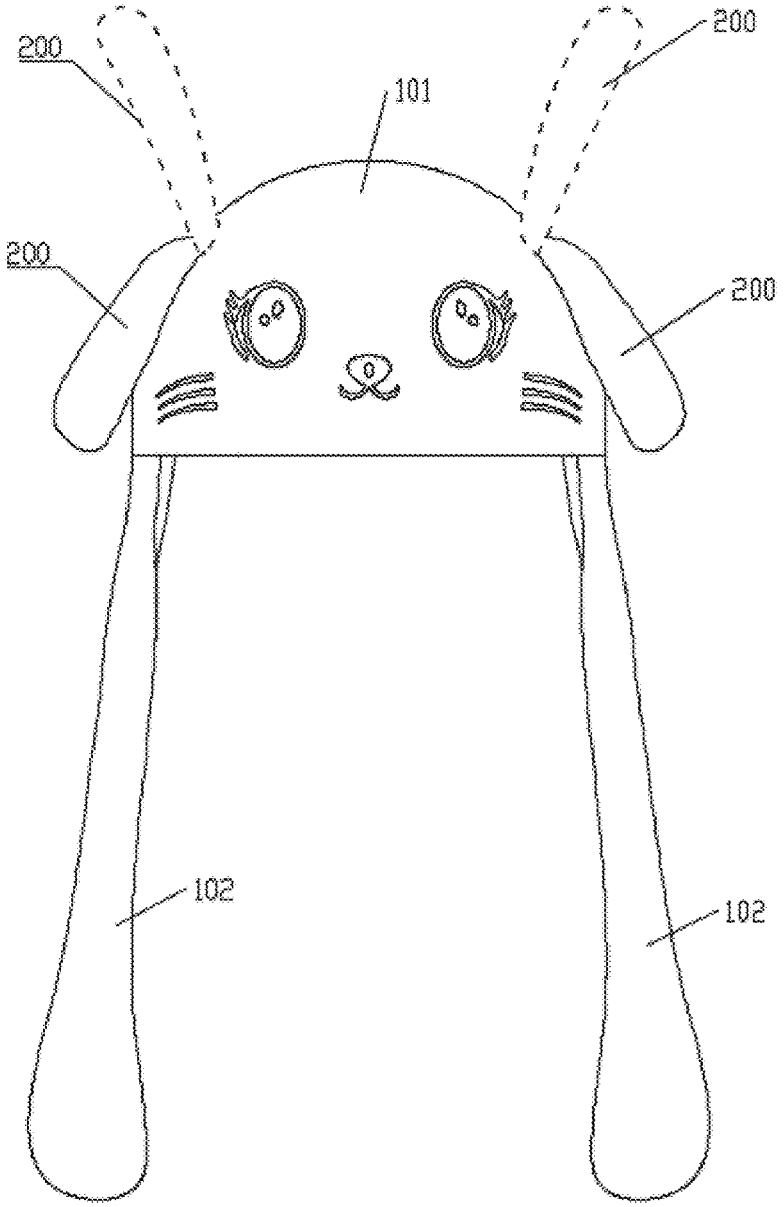
FIG. 5 is a schematic structural diagram of an ornament provided by the embodiment of the present invention.

As shown in FIG. 5 and FIG. 6, the embodiment further provides an ornament, which comprises the fabric and the control structure above, the control structure is arranged in the fabric, the fabric comprises the body and the moving structure 200 connected to the body, and at least the moving portion 21 is arranged in the moving structure 200, so that the moving structure 200 is moved along with the movement of the moving portion 21. Specifically, when the actuating portion 2 is in the folded state, the moving structure 200 is close to the body, and the moving structure 200 is folded, and when the actuating portion 2 is in the folded state due to the movement of the moving portion 21, a free end of the moving structure 200 (one end not connected with the body) is moved away from the body, and the moving structure 200 is unfolded.

As shown in FIG. 5 and FIG. 6, in a specific embodiment, the ornament is a headgear imitating a rabbit, a shape of the fabric is similar to a head of a rabbit, and the moving structures 200 in the fabric correspond to ears of the rabbit. The user may wear the headgear on the head, squeeze the air bags 1, and switch the actuating portions 2 to the unfolded state, so that the moving structures 200 (ears) are unfolded and the moving structures 200 (ears) are erected (as shown in dotted lines in FIG. 5 and FIG. 6). When the air bags 1 are released, the actuating portions 2 are restored to the folded state, so that the moving structures 200 (ear) are folded and the moving structures 200 (ears) are hung down. In the embodiment, one connecting pipe 3 is connected with one actuating portion 2, two moving structures 200 (ears) are provided, two control structures are arranged in the ornament, and each control structure corresponds to one moving structure 200 (ear) to control the movement of the moving structure 200 (ear) respectively.

In other alternative embodiments, the ornament may also be in other shapes, for example, the ornament may also imitate a bear, a dog, and the like, and the moving structures 200 are not limited to ears of an animal, but may also correspond to upper limbs or lower limbs of the animal.

Optionally, an opening (not shown in the drawings) may be arranged between the moving structure 200 and the body, and the actuating portion 2 can enter and withdraw from the fabric through the opening, so that on one hand, the opening may be blocked when the moving structure 200 is folded, and on the other hand, it is convenient to replace the actuating portion 2 without damaging the fabric.

As shown in FIG. 6, the fixed portion 22 is located at a joint of the body and the moving structure 200, so that it is convenient to take out the actuating portion 2 from the opening. The moving portion 21 is located in the moving structure 200, so that the moving structure 200 is driven to move when the moving portion 21 is moved.

The body may comprise a headgear body 101 and an extension sleeve 102. The headgear body 101 may be worn on the head of human body, the extension sleeve 102 naturally hangs down and extends from the neck of human body to the waist, and the air bag 1 is located at a lower end of the extension sleeve 102, so as to facilitate the user to squeeze the air bag 1.

As shown in FIG. 6, in order to facilitate the fixation of the control structure, a limit channel 103 may also be arranged in the fabric, the connecting pipe 3 of the control structure extends along the limit channel 103, and the air bag 1 and the actuating portion 2 of the control structure are located outside the limit channel 103, and located at two ends of the limit channel 103. Specifically, the actuating portion 2 is located at an upper end of the limit channel 103, and the air bag 1 is located at a lower end of the limit channel 103. Further, a cross-sectional dimension of the limit channel 103 is smaller than those of the air bag 1 and the actuator 2 to prevent the air bag 1 and the actuating portion 2 from entering the limit channel 103.

The limit channel 103 extends downward from a lower side of the moving structure 200 and extends to the extension sleeve 102, and the limit channel 103 continues to extend downward along the extension sleeve 102 until the limit channel reaches a position on the extension sleeve 102 close to the lower end.

Specifically, the limit channel 103 may be connected in the body, or two opposite sides of a lining of the body may be sewn with two lines, and the limit channel 103 is enclosed by the two lines and the lining between the two lines.

Although the present invention has been described in detail by general descriptions, specific embodiments and experiments above, it is obvious to those skilled in the art that some modifications or improvements can be made on the basis of the present invention. Therefore, these modifications or improvements made without departing from the spirit of the present invention all belong to the scope of protection of the present invention.

I claim:

1. A control structure, comprising an air bag and an actuating portion which are communicated, wherein the actuating portion comprises a fixed portion and moving portions, the fixed portion and each moving portion are connected at an included angle, at least two moving portions are provided; wherein, when the air bag is squeezed, a volume of the air bag is decreased, and air in the air bag enters the actuating portion, so that the moving portion is moved and the included angle between the fixed portion and the moving portion is increased, thus switching a folded state of the actuating portion to an unfolded state;

wherein the control structure further comprises a connecting pipe, and the air bag and the actuating portion are connected through the connecting pipe;

wherein the control structure further comprises a valve, the valve is connected to the connecting pipe, and the valve is configured to let external air enter the connecting pipe and restrict air in the connecting pipe from flowing out;

wherein the valve comprises a valve body and a valve sheet, a valve cavity is arranged in the valve body, the valve body is further defined with an air channel and an air inlet which are both communicated with the valve cavity, a first opening at a first end of the air channel is connected with the connecting pipe, a second end of the air channel is also defined with a second opening, wherein the first end is opposite to the second end, and the second opening is communicated with the valve cavity.

2. The control structure according to claim 1, wherein the connecting pipe is detachably connected with the actuating portion.

3. The control structure according to claim 1, wherein one end of one connecting pipe is connected with the actuating portion.

4. The control structure according to claim 1, wherein the air bag and/or the actuating portion are made of blow-molded plastic or thermoplastic rubber.

5. The control structure according to claim 1, wherein the volume of the air bag is greater than that of the actuating portion.

6. The control structure according to claim 5, wherein the volume of the air bag is 4 to 30 times that of the actuating portion.

7. The control structure according to claim 1, wherein the moving portion is in a hollow flat structure.

8. An ornament, comprising a fabric and the control structure according to claim 1 arranged in the fabric, wherein the fabric comprises a body and a moving structure connected to the body, and the moving portion is arranged in the moving structure.

9. The ornament according to claim 8, wherein a limit channel is arranged in the fabric, the connecting pipe of the control structure extends along the limit channel, and the air bag and the actuating portion of the control structure are located outside the limit channel, and located at two ends of the limit channel.

10. The ornament according to claim 8, wherein the moving portion is located in the moving structure.

* * * * *